US007556715B2

(12) United States Patent
Gaston et al.

(10) Patent No.: US 7,556,715 B2
(45) Date of Patent: Jul. 7, 2009

(54) BITUMINOUS FROTH INLINE STEAM INJECTION PROCESSING

(75) Inventors: Les Gaston, Fort McMurray (CA); Donald Norman Madge, Calgary (CA); William Lester Strand, Edmonton (CA); Ian Noble, Fort McMurray (CA); William Nicholas Garner, Fort McMurray (CA); Mike Lam, Fort McMurray (CA)

(73) Assignee: Suncor Energy, Inc., Fort McMurray, Alberta (CA)

( * ) Notice: Subject to any disclaimer, the term of this patent is extended or adjusted under 35 U.S.C. 154(b) by 208 days.

(21) Appl. No.: 10/825,230

(22) Filed: Apr. 16, 2004

(65) Prior Publication Data

US 2005/0150816 A1 Jul. 14, 2005

(30) Foreign Application Priority Data

Jan. 9, 2004 (CA) ..... 2455011

(51) Int. Cl.
*B01D 11/00* (2006.01)
*C10G 1/04* (2006.01)

(52) U.S. Cl. ..... 196/14.52; 208/390; 208/391; 209/12.1; 95/262; 366/101

(58) Field of Classification Search ..... 196/14.52; 208/11, 391, 390; 95/262, 242; 209/12.1; 366/101, 152.5
See application file for complete search history.

(56) References Cited

U.S. PATENT DOCUMENTS 685,895 A 11/1901 Wirth ..... 548/444

(Continued)

FOREIGN PATENT DOCUMENTS

CA 280272 5/1928 ..... 196/27

(Continued)

OTHER PUBLICATIONS

Fenske, McCormick, Lawroski, and Geier, "Extraction of Petroleum Fractions by Ammonia Solvents", E.I.Ch.E. Journal, vol. 1. No. 3. pp. 335-341.

(Continued)

*Primary Examiner*—N. Bhat
(74) *Attorney, Agent, or Firm*—Knobbe Martens Olson and Bear, LLP

(57) ABSTRACT

An inline bitumen froth steam heater system is comprised of steam injection and static mixing devices. The steam heater system heats and de-aerates an input bitumen froth without creating downstream processing problems with the bitumen froth such as emulsification or live steam entrainment. The inline bitumen froth steam heater is a multistage unit that injects and thoroughly mixes the steam with bitumen resulting in an output bitumen material having a homogenous temperature of about 190° F. The heating system conditions a superheated steam supply to obtain saturated steam at about 300° F. The saturated steam is contacted with a bitumen froth flow and mixed in a static mixer stage. The static mixers provide a surface area and rotating action that allows the injected steam to condense and transfer its heat to the bitumen froth. The mixing action and the increase in temperature of the bitumen froth results in reduction in bitumen viscosity and also allows the release of entrapped air from the bitumen froth.

22 Claims, 2 Drawing Sheets

U.S. PATENT DOCUMENTS

| | | | | | |
|---|---|---|---|---|---|
| 1,590,156 | A | | 6/1926 | Ellis | 106/311 |
| 1,598,973 | A | | 9/1926 | Kolsky | 208/112 |
| 2,052,881 | A | | 9/1936 | Klipstein et al. | 260/103 |
| 2,236,796 | A | | 4/1941 | Kipper | 134/56 |
| 2,734,019 | A | | 2/1956 | Miller et al. | 208/212 |
| 2,847,353 | A | | 8/1958 | Beavon | 196/14.11 |
| 2,910,424 | A | | 10/1959 | Tek et al. | 208/11 |
| 2,921,023 | A | | 1/1960 | Holm | 208/263 |
| 3,159,562 | A | * | 12/1964 | Bichard et al. | 208/391 |
| 3,509,641 | A | * | 5/1970 | Evans et al. | 34/134 |
| 3,594,201 | A | | 7/1971 | Sommer et al. | 106/277 |
| 3,617,530 | A | | 11/1971 | Rieve et al. | 208/253 |
| 3,798,157 | A | | 3/1974 | Manzanilla et al. | 208/251 |
| 3,807,090 | A | | 4/1974 | Moss | 48/128 |
| 3,808,120 | A | | 4/1974 | Smith | 208/11 |
| 3,876,532 | A | | 4/1975 | Plundo et al. | 208/216 |
| 3,893,907 | A | | 7/1975 | Canevari | 208/11 |
| 3,967,777 | A | | 7/1976 | Canevari | 233/3 |
| 3,971,718 | A | | 7/1976 | Reid | 210/84 |
| 3,998,702 | A | * | 12/1976 | Opoku | 196/14.52 |
| 4,033,853 | A | * | 7/1977 | Hann | 208/39 |
| 4,035,282 | A | | 7/1977 | Stuchberry et al. | 208/11 |
| 4,072,609 | A | | 2/1978 | Kizior | 210/73 |
| 4,101,333 | A | | 7/1978 | Wayment | 106/85 |
| 4,116,809 | A | | 9/1978 | Kizior | 208/11 |
| 4,120,776 | A | | 10/1978 | Miller et al. | 208/11 |
| 4,172,025 | A | | 10/1979 | Porteous et al. | 208/11 |
| 4,279,743 | A | | 7/1981 | Miller | 209/211 |
| 4,305,733 | A | | 12/1981 | Scholz et al. | 48/196 |
| 4,337,143 | A | | 6/1982 | Hanson et al. | |
| 4,383,914 | A | | 5/1983 | Kizior | 208/177 |
| 4,397,741 | A | | 8/1983 | Miller | 209/170 |
| 4,399,027 | A | | 8/1983 | Miller | 209/164 |
| 4,399,112 | A | | 8/1983 | Voirin | 423/230 |
| 4,409,090 | A | | 10/1983 | Hanson et al. | 208/11 |
| 4,410,417 | A | | 10/1983 | Miller et al. | 208/11 |
| 4,424,113 | A | * | 1/1984 | Mitchell | 208/391 |
| 4,437,998 | A | | 3/1984 | Yong | 210/728 |
| 4,462,892 | A | | 7/1984 | Schramm et al. | 208/11 |
| 4,470,899 | A | | 9/1984 | Miller et al. | 208/11 |
| 4,486,294 | A | | 12/1984 | Miller et al. | 208/11 |
| 4,502,950 | A | | 3/1985 | Ikematsu et al. | 208/309 |
| 4,514,287 | A | | 4/1985 | Ikematsu et al. | 208/309 |
| 4,514,305 | A | | 4/1985 | Filby | 210/703 |
| 4,525,155 | A | | 6/1985 | Nilsson | 494/3 |
| 4,525,269 | A | | 6/1985 | Ikematsu et al. | 208/309 |
| 4,528,100 | A | | 7/1985 | Zarchy | 210/634 |
| 4,532,024 | A | | 7/1985 | Haschke et al. | 208/11 |
| 4,545,892 | A | | 10/1985 | Cymbalisty et al. | 208/11 |
| 4,581,142 | A | | 4/1986 | Fladby et al. | 210/512.1 |
| 4,585,180 | A | | 4/1986 | Potts | 241/186 |
| 4,604,988 | A | | 8/1986 | Rao | 126/360 A |
| 4,634,519 | A | | 1/1987 | Danzik | 208/263 |
| 4,677,074 | A | | 6/1987 | Holden | 423/541 |
| 4,733,828 | A | | 3/1988 | Potts | 241/236 |
| 4,744,890 | A | | 5/1988 | Miller et al. | 209/164 |
| 4,781,331 | A | | 11/1988 | Potts | 241/236 |
| 4,783,268 | A | | 11/1988 | Leung | 210/703 |
| 4,799,627 | A | | 1/1989 | Potts | 241/236 |
| 4,828,393 | A | | 5/1989 | Smals et al. | 366/2 |
| 4,838,434 | A | | 6/1989 | Miller et al. | 209/164 |
| 4,851,123 | A | | 7/1989 | Mishra | 210/609 |
| 4,859,317 | A | | 8/1989 | Shelfantook et al. | 208/391 |
| 4,915,819 | A | | 4/1990 | Chirinos et al. | 208/309 |
| 4,981,579 | A | | 1/1991 | Paspek et al. | 208/314 |
| 4,994,097 | A | | 2/1991 | Brouwers | 55/317 |
| 5,009,773 | A | | 4/1991 | Schramm et al. | 208/391 |
| 5,017,281 | A | | 5/1991 | Sadeghi et al. | 208/390 |
| 5,032,275 | A | | 7/1991 | Thew | 210/512.1 |
| 5,039,398 | A | | 8/1991 | Stine et al. | 208/192 |
| 5,055,202 | A | | 10/1991 | Carroll et al. | 210/739 |
| 5,073,177 | A | | 12/1991 | Brouwers | 55/317 |
| 5,092,983 | A | | 3/1992 | Eppig et al. | 208/323 |
| 5,118,408 | A | | 6/1992 | Jansen et al. | 209/164 |
| 5,124,008 | A | | 6/1992 | Rendall et al. | 204/61 |
| 5,143,598 | A | | 9/1992 | Graham et al. | 208/390 |
| 5,156,751 | A | | 10/1992 | Miller | 210/787 |
| 5,186,820 | A | | 2/1993 | Schultz et al. | 209/164 |
| 5,207,805 | A | | 5/1993 | Kalen et al. | 55/1 |
| 5,223,148 | A | | 6/1993 | Tipman et al. | 210/744 |
| 5,236,577 | A | | 8/1993 | Tipman et al. | 208/390 |
| 5,242,580 | A | | 9/1993 | Sury | 208/400 |
| 5,242,604 | A | | 9/1993 | Young et al. | 210/768 |
| 5,264,118 | A | | 11/1993 | Cymerman et al. | 208/390 |
| 5,295,350 | A | | 3/1994 | Child et al. | 60/39.02 |
| 5,316,664 | A | | 5/1994 | Gregoli et al. | 208/390 |
| 5,340,467 | A | | 8/1994 | Gregoli et al. | 208/390 |
| 5,480,566 | A | | 1/1996 | Strand | 210/772 |
| 5,538,539 | A | | 7/1996 | Spokoyny et al. | 96/52 |
| 5,540,755 | A | | 7/1996 | Spokoyny et al. | 95/3 |
| 5,581,864 | A | | 12/1996 | Rabet | 210/202 |
| 5,626,191 | A | | 5/1997 | Greaves et al. | 166/245 |
| 5,645,714 | A | | 7/1997 | Strand et al. | 208/391 |
| 5,667,543 | A | | 9/1997 | Brouwers | 55/317 |
| 5,723,042 | A | | 3/1998 | Strand et al. | 208/391 |
| 5,740,834 | A | | 4/1998 | Sherowski | 137/527.6 |
| 5,798,087 | A | | 8/1998 | Suda et al. | 423/555 |
| 5,820,750 | A | | 10/1998 | Blum et al. | 208/263 |
| 5,876,592 | A | | 3/1999 | Tipman et al. | 208/390 |
| 5,897,769 | A | | 4/1999 | Trachte et al. | 208/263 |
| 5,910,242 | A | | 6/1999 | Halbert et al. | 208/263 |
| 5,928,501 | A | | 7/1999 | Sudhakar et al. | 208/263 |
| 5,961,821 | A | | 10/1999 | Varadaraj et al. | 208/263 |
| 5,968,349 | A | | 10/1999 | Duyvesteyn et al. | 208/390 |
| 5,985,137 | A | | 11/1999 | Ohsol et al. | 208/263 |
| 5,985,138 | A | | 11/1999 | Humphreys | 208/391 |
| 6,007,709 | A | * | 12/1999 | Duyvesteyn et al. | 208/391 |
| 6,033,187 | A | | 3/2000 | Addie | 417/18 |
| 6,063,266 | A | | 5/2000 | Grande et al. | 208/263 |
| 6,086,751 | A | | 7/2000 | Bienstock | 208/263 |
| 6,096,196 | A | | 8/2000 | Varadaraj et al. | 208/263 |
| 6,119,870 | A | | 9/2000 | Maciejewski et al. | 209/725 |
| 6,123,835 | A | | 9/2000 | Ackerson et al. | 208/213 |
| 6,132,630 | A | | 10/2000 | Briant et al. | 210/774 |
| 6,149,887 | A | | 11/2000 | Lagas et al. | 423/578.1 |
| 6,162,350 | A | | 12/2000 | Soled | 208/113 |
| 6,183,341 | B1 | | 2/2001 | Melcer | 451/5 |
| 6,214,213 | B1 | | 4/2001 | Tipman et al. | 208/390 |
| 6,281,328 | B1 | | 8/2001 | Sartori et al. | 528/492 |
| 6,319,099 | B1 | | 11/2001 | Tanoue et al. | 451/60 |
| 6,358,404 | B1 | | 3/2002 | Brown et al. | 208/390 |
| 6,391,190 | B1 | * | 5/2002 | Spence et al. | 208/390 |
| 6,398,973 | B1 | | 6/2002 | Saunders et al. | 210/788 |
| 6,412,557 | B1 | | 7/2002 | Ayasse et al. | 166/261 |
| 6,428,686 | B1 | | 8/2002 | Ackerson et al. | 208/213 |
| 6,464,859 | B1 | | 10/2002 | Duncum et al. | 208/263 |
| 6,521,079 | B1 | | 2/2003 | Roy | 156/345.12 |
| 6,531,055 | B1 | | 3/2003 | Greaney | 208/263 |
| 6,585,560 | B2 | | 7/2003 | Tanoue et al. | 451/5 |
| 6,596,170 | B2 | | 7/2003 | Tuszko et al. | 210/512.1 |
| 6,640,548 | B2 | | 11/2003 | Brushwood et al. | 60/776 |
| 6,702,877 | B1 | | 3/2004 | Swanborn | 95/269 |
| 6,768,115 | B2 | | 7/2004 | Mikula et al. | 250/339.11 |
| 6,800,116 | B2 | * | 10/2004 | Stevens et al. | 95/262 |
| 6,818,058 | B2 | | 11/2004 | Ronin | 106/705 |
| 6,907,831 | B1 | | 6/2005 | Rising | 110/345 |
| 6,991,037 | B2 | | 1/2006 | Hocking | 166/308.1 |
| 7,013,937 | B2 | | 3/2006 | Potts | 141/387 |
| 7,056,487 | B2 | | 6/2006 | Newby | 423/650 |
| 7,141,162 | B2 | | 11/2006 | Garner et al. | 210/202 |
| 2001/0005986 | A1 | | 7/2001 | Matsubara et al. | 55/459.1 |
| 2001/0042713 | A1 | | 11/2001 | Conrad et al. | 210/512.1 |
| 2002/0148755 | A1 | | 10/2002 | Ackerson et al. | 208/209 |
| 2002/0148777 | A1 | | 10/2002 | Tuszko et al. | 210/512.1 |

| | | | | |
|---|---|---|---|---|
| 2003/0000214 | A1 | 1/2003 | Grewe et al. | 60/670 |
| 2003/0029775 | A1 | 2/2003 | Cymerman et al. | 208/187 |
| 2003/0056517 | A1 | 3/2003 | Brushwood et al. | 60/776 |
| 2003/0070963 | A1 | 4/2003 | Zimmermann et al. | 208/106 |
| 2003/0168391 | A1 | 9/2003 | Tveiten | 210/188 |
| 2003/0205507 | A1 | 11/2003 | Mikula et al. | 208/391 |
| 2004/0011057 | A1 | 1/2004 | Huber | 60/781 |
| 2004/0055972 | A1 | 3/2004 | Garner et al. | 210/787 |
| 2004/0069705 | A1 | 4/2004 | Tuszko et al. | 210/512.1 |
| 2004/0094456 | A1 | 5/2004 | Dries | 208/113 |
| 2004/0164001 | A1 | 8/2004 | Rhodey | 208/390 |
| 2004/0172951 | A1 | 9/2004 | Hannemann et al. | 60/776 |
| 2004/0182754 | A1 | 9/2004 | Lange | 209/115 |
| 2004/0247509 | A1 | 12/2004 | Newby | 423/240 |
| 2004/0251731 | A1 | 12/2004 | Potts | 299/18 |
| 2005/0051500 | A1 | 3/2005 | Price et al. | 210/767 |
| 2005/0126455 | A1 | 6/2005 | Rising | 110/345 |
| 2005/0173726 | A1 | 8/2005 | Potts | 257/134 |
| 2005/0226094 | A1 | 10/2005 | Damhuis | 366/175.3 |
| 2006/0091249 | A1 | 5/2006 | Potts | 241/236 |
| 2006/0138036 | A1 | 6/2006 | Garner et al. | 210/202 |
| 2006/0138055 | A1 | 6/2006 | Garnet et al. | 210/703 |
| 2006/0248872 | A1 | 11/2006 | Bachovchin et al. | 60/39.12 |
| 2007/0006526 | A1 | 1/2007 | Cullen | 44/589 |

FOREIGN PATENT DOCUMENTS

| | | | |
|---|---|---|---|
| CA | 630710 | 11/1961 | 196/22 |
| CA | 680576 | 2/1964 | 196/18 |
| CA | 694547 | 9/1964 | 361/34 |
| CA | 741303 | 8/1966 | 196/23 |
| CA | 857306 | 1/1970 | 196/23 |
| CA | 841581 | 5/1970 | 196/23 |
| CA | 882667 | 5/1971 | 196/17 |
| CA | 873854 | 6/1971 | 196/23 |
| CA | 889825 | 1/1972 | 196/23 |
| CA | 910271 | 9/1972 | 196/17 |
| CA | 952844 | 8/1974 | 196/22 |
| CA | 970308 | 7/1975 | 196/17 |
| CA | 1026252 | 2/1978 | 196/22 |
| CA | 1027853 | 3/1978 | 166/31 |
| CA | 1041451 | 10/1978 | 196/24 |
| CA | 1029322 | 11/1978 | 196/132 |
| CA | 1044628 | 12/1978 | 196/19 |
| CA | 1055868 | 5/1979 | 196/23 |
| CA | 1059052 | 7/1979 | 196/22 |
| CA | 1066644 | 11/1979 | 196/22 |
| CA | 1072473 | 2/1980 | 196/22 |
| CA | 1072474 | 2/1980 | 196/22 |
| CA | 1080375 | 6/1980 | 361/29 |
| CA | 1081641 | 7/1980 | 196/22 |
| CA | 1094003 | 1/1981 | 196/17 |
| CA | 1097574 | 3/1981 | 182/141 |
| CA | 1126187 | 6/1982 | 196/17 |
| CA | 1137906 | 12/1982 | 196/19 |
| CA | 1138822 | 4/1983 | 209/85 |
| CA | 1144098 | 4/1983 | 196/22 |
| CA | 1153347 | 6/1983 | 241/123 |
| CA | 1164383 | 3/1984 | 196/24 |
| CA | 1163257 | 6/1984 | 241/123 |
| CA | 1180426 | 1/1985 | 341/71 |
| CA | 1194622 | 1/1985 | 361/29 |
| CA | 1193586 | 9/1985 | 241/55 |
| CA | 1182463 | 12/1985 | 260/363.3 |
| CA | 1201412 | 4/1986 | 204/171 |
| CA | 1210167 | 8/1986 | 361/34 |
| CA | 1214421 | 11/1986 | 196/19 |
| CA | 1231692 | 1/1988 | 241/123 |
| CA | 1232854 | 2/1988 | 196/1 |
| CA | 1236065 | 5/1988 | 233/10 |
| CA | 1251772 | 3/1989 | 196/54 |
| CA | 1254171 | 5/1989 | 204/171.7 |
| CA | 1266250 | 2/1990 | 196/22 |
| CA | 1266261 | 2/1990 | 241/123 |
| CA | 1266844 | 3/1990 | 196/130 |
| CA | 1267860 | 4/1990 | 196/22 |
| CA | 1270220 | 6/1990 | 196/19 |
| CA | 1272153 | 7/1990 | 196/136 |
| CA | 1275063 | 10/1990 | 196/19 |
| CA | 1288375 | 3/1991 | 196/133 |
| CA | 2037856 | 10/1991 | 182/152 |
| CA | 1293465 | 12/1991 | 196/21 |
| CA | 2022300 | 1/1992 | 209/3 |
| CA | 2058221 | 1/1992 | |
| CA | 1301692 | 5/1992 | 196/23 |
| CA | 2054620 | 5/1992 | |
| CA | 1303702 | 6/1992 | 341/34 |
| CA | 1304314 | 6/1992 | 198/19 |
| CA | 1305392 | 7/1992 | 362/65 |
| CA | 1313550 | 2/1993 | 341/91 |
| CA | 1313845 | 2/1993 | 209/70 |
| CA | 1317277 | 4/1993 | 196/130 |
| CA | 1318273 | 5/1993 | 196/30 |
| CA | 1318876 | 6/1993 | 196/40 |
| CA | 2088179 | 8/1993 | |
| CA | 1323173 | 10/1993 | 23/332 |
| CA | 1325180 | 12/1993 | 182/149 |
| CA | 2108521 | 4/1994 | |
| CA | 1329277 | 5/1994 | 361/36 |
| CA | 2086073 | 6/1994 | |
| CA | 2000984 | 8/1994 | 196/20 |
| CA | 2106900 | 3/1995 | |
| CA | 2049793 | 6/1995 | |
| CA | 1337410 | 10/1995 | |
| CA | 2133911 | 4/1996 | |
| CA | 2029795 | 5/1996 | 196/17 |
| CA | 2178189 | 12/1996 | |
| CA | 2229342 | 3/1997 | |
| CA | 2015979 | 10/1997 | |
| CA | 2088203 | 10/1997 | |
| CA | 2180686 | 10/1997 | |
| CA | 2021185 | 9/1998 | |
| CA | 2029756 | 9/1998 | |
| CA | 2200899 | 9/1998 | |
| CA | 2232929 | 9/1998 | |
| CA | 2208767 | 12/1998 | |
| CA | 2263691 | 12/1998 | |
| CA | 2294860 | 12/1998 | |
| CA | 2088227 | 2/1999 | |
| CA | 2242394 | 2/1999 | |
| CA | 2250623 | 4/1999 | |
| CA | 2220821 | 5/1999 | |
| CA | 2308410 | 5/1999 | |
| CA | 2255071 | 6/1999 | |
| CA | 2249679 | 8/1999 | |
| CA | 2227520 | 9/1999 | |
| CA | 2266570 | 9/1999 | |
| CA | 2236183 | 10/1999 | |
| CA | 2273123 | 12/1999 | |
| CA | 2345271 | 4/2000 | |
| CA | 2231321 | 6/2000 | |
| CA | 2176639 | 8/2000 | |
| CA | 2140380 | 9/2000 | |
| CA | 2198623 | 10/2000 | |
| CA | 2184613 | 11/2000 | |
| CA | 2182453 | 12/2000 | |
| CA | 2304938 | 2/2001 | |
| CA | 2397612 | 7/2001 | |
| CA | 2365008 | 8/2001 | |
| CA | 2254048 | 9/2001 | |
| CA | 2358805 | 10/2001 | |
| CA | 2246841 | 11/2001 | |
| CA | 2311738 | 11/2001 | |
| CA | 2409129 | 11/2001 | |
| CA | 2332207 | 2/2002 | |
| CA | 2315596 | 4/2002 | |

| | | |
|---|---|---|
| CA | 2217300 | 8/2002 |
| CA | 2227667 | 11/2002 |
| CA | 2350001 | 12/2002 |
| CA | 2353109 | 1/2003 |
| CA | 2454278 | 1/2003 |
| CA | 2259037 | 4/2003 |
| CA | 2569689 | 4/2003 |
| CA | 2398026 | 6/2003 |
| CA | 2419325 | 8/2003 |
| CA | 2498862 | 10/2003 |
| CA | 2518040 | 12/2003 |
| CA | 2448680 | 2/2004 |
| CA | 2400258 | 3/2004 |
| CA | 2471048 | 3/2004 |
| CA | 2522514 | 4/2004 |
| CA | 2435113 | 1/2005 |
| CA | 2307819 | 4/2005 |
| CA | 2548370 | 5/2005 |
| CA | 2548371 | 5/2005 |
| CA | 2453697 | 6/2005 |
| CA | 2493677 | 6/2005 |
| CA | 2549895 | 6/2005 |
| CA | 2455623 | 7/2005 |
| CA | 2243957 | 9/2005 |
| CA | 2509308 | 9/2005 |
| CA | 2509309 | 9/2005 |
| CA | 2562974 | 10/2005 |
| CA | 2558059 | 11/2005 |
| CA | 2538464 | 2/2006 |
| CA | 2521335 | 3/2006 |
| CA | 2248129 | 4/2006 |
| CN | 1112033 | 11/1995 |
| CN | 2263552 Y | 10/1997 |
| CN | 2520942 Y | 11/2002 |
| CN | 1701856 | 11/2005 |
| DE | 2153098 | 4/1972 |
| EP | 262916 | 6/1988 |
| EP | 1234914 | 8/1988 |
| EP | 355127 | 2/1990 |
| EP | 286160 | 5/1990 |
| EP | 493858 B1 | 8/1992 |
| EP | 332641 | 3/1994 |
| EP | 605746 | 7/1994 |
| EP | 1028811 | 8/2000 |
| EP | 1586546 A2 | 10/2005 |
| EP | 1600215 | 11/2005 |
| EP | 1501636 | 8/2006 |
| GB | 17954 | 5/1913 |
| GB | 169063 | 9/1921 |
| GB | 195055 | 1/1924 |
| GB | 539383 | 8/1941 |
| GB | 552880 | 4/1943 |
| GB | 591347 | 8/1947 |
| GB | 603082 | 9/1948 |
| GB | 634135 | 3/1950 |
| GB | 665472 | 7/1952 |
| GB | 723149 | 2/1955 |
| GB | 726841 | 3/1955 |
| GB | 723489 | 9/1955 |
| GB | 767605 | 2/1957 |
| GB | 767944 | 2/1957 |
| GB | 768107 | 2/1957 |
| GB | 773121 | 4/1957 |
| GB | 789228 | 1/1958 |
| GB | 808104 | 10/1958 |
| GB | 807713 | 1/1959 |
| GB | 814610 | 6/1959 |
| GB | 815155 | 6/1959 |
| GB | 957048 | 5/1964 |
| GB | 1253701 | 11/1971 |
| GB | 1302064 | 1/1973 |
| GB | 1428174 | 3/1976 |
| GB | 1510053 | 5/1978 |
| GB | 1510054 | 5/1978 |
| GB | 1527940 | 10/1978 |
| GB | 2047735 | 1/1980 |
| GB | 2075543 | 11/1981 |
| GB | 2116447 | 9/1983 |
| JP | 0053142396 | 12/1978 |
| JP | 61082856 | 4/1986 |
| JP | 0005096492 | 4/1993 |
| JP | 0005208815 | 8/1993 |
| JP | 0007237921 | 9/1995 |
| WO | WO 83/00318 | 2/1983 |
| WO | WO 83/02071 | 6/1983 |
| WO | WO 83/03062 | 9/1983 |
| WO | WO 83/03444 | 10/1983 |
| WO | WO 86/00302 | 1/1986 |
| WO | WO 86/07396 | 12/1986 |
| WO | WO 93/25751 | 12/1993 |
| WO | WO 94/11444 | 5/1994 |
| WO | WO 94/19091 | 9/1994 |
| WO | WO 94/23823 | 10/1994 |
| WO | WO 95/07750 | 3/1995 |
| WO | WO 96/06899 | 3/1996 |
| WO | WO 96/29149 | 9/1996 |
| WO | WO 98/58739 | 12/1998 |
| WO | WO 99/36174 | 7/1999 |
| WO | WO 99/54049 | 10/1999 |
| WO | WO 00/10896 | 3/2000 |
| WO | WO 00/29507 | 5/2000 |
| WO | WO 00/35585 | 6/2000 |
| WO | WO 00/74815 | 12/2000 |
| WO | WO 01/53660 | 7/2001 |
| WO | WO 01/85611 | 11/2001 |
| WO | WO 02/074881 | 9/2002 |
| WO | WO 02/092231 | 11/2002 |
| WO | WO 03/006165 | 1/2003 |
| WO | WO 03/008768 | 1/2003 |
| WO | WO 03/045544 | 6/2003 |
| WO | WO 03/047730 | 6/2003 |
| WO | WO 03/056134 | 10/2003 |
| WO | WO 03/082455 | 10/2003 |
| WO | WO 03/092901 | 11/2003 |
| WO | WO 03/074394 | 12/2003 |
| WO | WO 2004/005673 | 1/2004 |
| WO | WO 2004/094061 | 4/2004 |
| WO | WO 2005/046874 | 5/2005 |
| WO | WO 2005/046875 | 5/2005 |
| WO | WO 2005/000454 | 6/2005 |
| WO | WO 2005/069804 | 8/2005 |
| WO | WO 2005/070821 | 8/2005 |
| WO | WO 2005/080878 | 9/2005 |
| WO | WO 2005/092479 | 10/2005 |
| WO | WO 2005/092788 | 10/2005 |
| WO | WO 2005/072877 | 11/2005 |
| WO | WO 2005/123226 | 12/2005 |
| WO | WO 2006/034339 | 3/2006 |
| WO | WO 2006/040269 | 4/2006 |
| WO | WO 2006/035209 | 6/2006 |
| WO | WO 2006/037045 | 6/2006 |
| WO | WO 2006/065459 | 6/2006 |
| WO | WO 2006/085759 | 8/2006 |
| WO | WO 2006/121503 | 11/2006 |
| WO | WO2006/132527 | 12/2006 |
| WO | WO2007/001174 | 1/2007 |
| WO | WO2007/021181 | 2/2007 |

OTHER PUBLICATIONS

Natural Resources Canada, Treatment of Bitumen Froth and Slop Oil Tailings, National Energy Board, Canada's Oil Sands: A Supply and Market Outlook to 2015, An Energy Market Assessment Oct. 2000.

Krebs' Engineers, Krebs D-Series gMAX DeSanders for Oil and Gas, Bulletin 11-203WEL.

Alberta Oil History, An Interview with Roger Butler, vol. 2 Issue 2, pp. 33-35.
Lagowski, Liquid Ammonia—A Unique Solvent, Chemistry vol. 41, No. 4, pp. 10-15.
Lemley, Roberts, Plowman and Lagowski, Liquid Ammonia Solutions. X. A Raman Study of Interactions in the Liquid State, The Journal of Physical Chemistry vol. 77 No. 18, 1973 pp. 2185-2191.
Bratsch and lagowski, On the Existence of Na in Liquid Ammonia, 1984 American Chemical Society, 1086-1089 pp. 1086-1089.
New Logic Research, Using V SEP to Treat Desalter Effluent, Case Study Copyright 2003 9 pages.
Miner's Toolbox, Mine Backfill Engineering, 2000-2005.
Schramm et al. "Two Classes of Anionic Surfactants and Their Significance in Hot Water Processing of Oil Sands", Can. J. Chem. Eng., 65 (1987) 799-811.
Schramm et al. "Some Observations on the Aging Phenomenon in the Hot Water Processing of Athabasca Oil Sands. Part 1—The Nature of the Phenomenom", AOSTRA J. Res., 3 (1987) 195-214.
Schramm et al. "Some Observations on the Aging Phenomenon in the Hot Water Processing of Athabasca Oil Sands. Part 2—The Mechanism of Aging", AOSTRA J. Res., 3 (1987) 215-224.
Wallace et al. "A Physical Chemical Explanation for Deterioration in the Hot Water Processability of Athabasca Oil Sand Due to Aging", Fuel Sci. Technol. Int., 7 (1989) 699-725.
Eva Mondt "Compact Centrifugal Separator of Dispersed Phases" Proefschrift.
Schramm, Smith and Stone "The Influence of Natural Surfactant Concentration on the Hot Water Process for Recovering Bitumen from the Athabasca Oil Sands" AOSTRA Journal of Research, vol. 1, 1984 pp. 5-13.
Keller, Noble and Caffey "A Unique, Reagent-Based, Separation Method for Tar Sands and Environmentall Clean Ups" Presented to AIChE 2001 Annual Meeting Nov. 6, 2001 Reno, Nevada.
The Fine Tailings Fundamentals Consortium "Advances in Oil Sands Tailings Research" ISBN 0-7732-1691-X Published by Alberta Department of Energy Jun. 1995.
Industry Statistics "Monthly Petroleum Facts at a Glance" Jan. 2002 pp. 1-2.
IEO 1997 World Oil Markets "The World Oil Market" pp. 1-19.
Minespace 2001, Presentation slides "Identification ad Treatment of Weathered Ores at Suncor's Steepbank Mine", May 2, 2001, Quebec City, Canada.
District 5 CIM Conference, Presentation slides "Identification and Treatment of Weathered Ores at Suncor's Steepbank Mine", Jun. 14, 2001, Alberta, Canada.
Jones and Goldstein "The SkyMine Process", Skyonic Corporation Sep. 20, 2005.
Rimmer, Gregoli and Yildlrim, "Hydrocyclone-based Process for Rejecting Solids from Oil Sands at the Mine Site While Retaining Bitumen for Transportation to a Processing Plant"; Suncor Extraction 3rd fl pp. 93-100, Paper delivered on Monday Apr. 5, 1993 at a conference in Alberta, Canada entitled "Oil Sands-Our Petroleum Future".
Greaves, Tuwil and Bagci, "Horizontal Producer Wells in in Situ Combustion (ISC) Process", The Journal of Canadian Petroleum Technology, Apr. 1993, vol. 32, No. 4, pp. 58-67.
Collison, "Hot About Thai: A Calgary company researches a step-change in bitumen recovery technology", Oilweek Mar. 1, 2004, pp. 42-46.
Bagci and Shamsul, "A Comparison of Dry Forward Combusion with Diverse Well Configurations in a 3-D Physical Model Using Medium and Low Gravity Crudes", Middle East Technical University (10 pages).
European Commission, European Symposium on Heavy Oil Technologies in a Wider Europe, A Therme Programme Action Berlin, Jun. 7 & 8, 1994, Greaves, Wang and Al-Shamali, "Insitu Combustion (ISC) Processes: 3D Studies of Vertical and Horizontal Wells", IOR Research Group, School of Chemical Engineering, University of Bath, UK.
Al-Shamali and Greaves, "In Situ Combustion (ISC) Processes: Enhances Oil Recovery Using Horizontal Wells", School of Chemical Engineering, University of Bath, UK, Trans IChemE, vol. 71, Part A, May 1993, pp. 345-346.

* cited by examiner

BITUMINOUS FROTH INLINE STEAM INJECTION PROCESSING

FIELD OF THE INVENTION

This invention relates to bitumen processing and more particularly is related to heating bituminous froth using inline steam injection.

BACKGROUND TO THE INVENTION

In extracting bitumen hydrocarbons from tar sands, one extraction process separates bitumen from the sand ore in which it is found using an ore washing process generally referred to as the Clark hot water flotation method. In this process, a bitumen froth is typically recovered at about 150° F. and contains residual air from the flotation process. Consequently, the froth produced from the Clark hot water flotation method is usually described as aerated bitumen froth. Aerated bitumen froth at 150° F. is difficult to work with. It has similar properties to roofing tar. It is very viscous and does not readily accept heat. Traditionally, processing of aerated bitumen froth requires the froth to be heated to 190° to 200° F. and deaerated before it can move to the next stage of the process.

Heretofore, the aerated bitumen froth is heated and deaerated in large atmospheric tanks with the bitumen fed in near the top of the vessel and discharged onto a shed deck. The steam is injected below the shed deck and migrates upward, transferring heat and stripping air from the bitumen as they contact. The method works but much of the steam is wasted and bitumen droplets are often carried by the exiting steam and deposited on nearby vehicles, facilities and equipment.

SUMMARY OF THE INVENTION

The invention provides an inline steam heater to supply heated steam to a bitumen froth by direct contact of the steam to the bitumen froth resulting in superior in efficiency and environmental friendliness than processes heretofore employed.

In one of its aspect, the invention provides an inline bitumen froth steam heater system including at least one steam injection stage, each steam injection stage followed by a mixing stage. Preferably, the mixing stage obtains a mixing action using static mixing devices, for example, using baffle partitions in a pipe. In operation, the invention heats the bitumen froth and facilitates froth deaeration by elevating the froth temperature. In operation the bitumen froth heating is preferably obtained without creating downstream problems such as emulsification or live steam entrainment. The froth heater is a multistage unit that injects and thoroughly mixes the steam with bitumen resulting in solution at homogenous temperature. Steam heated to 300 degrees Fahrenheit is injected directly into a bitumen froth flowing in a pipeline where initial contact takes place. The two incompatible substances are then forced through a series of static mixers, causing the steam to contact the froth. The mixer surface area and rotating action of the material flowing through the static mixer breaks the components up into smaller particles, increasing contact area and allowing the steam to condense and transfer its heat to the froth. The reduction in bitumen viscosity also allows the release of entrapped air.

Other objects, features and advantages of the present invention will be apparent from the accompanying drawings, and from the detailed description that follows below. As will be appreciated, the invention is capable of other and different embodiments, and its several details are capable of modifications in various respects, all without departing from the invention. Accordingly, the drawings and description of the preferred embodiments are illustrative in nature and not restrictive

DETAILED DESCRIPTION OF THE INVENTION

In accordance with a preferred embodiment of the process two inputs components, namely, bitumen froth and steam, are contacted to produce an output homogenous bitumen product heated to a temperature of 190° F. The input bitumen froth component 10 is supplied at about 150° F. In a pilot plant implementation the input bitumen froth component is supplied via a 28 inch pipeline at a rate of about 10,000 barrels per hour. The input steam component 12 is supplied as a superheated steam at about 500° F. and at 150 psi.

Figure 1:
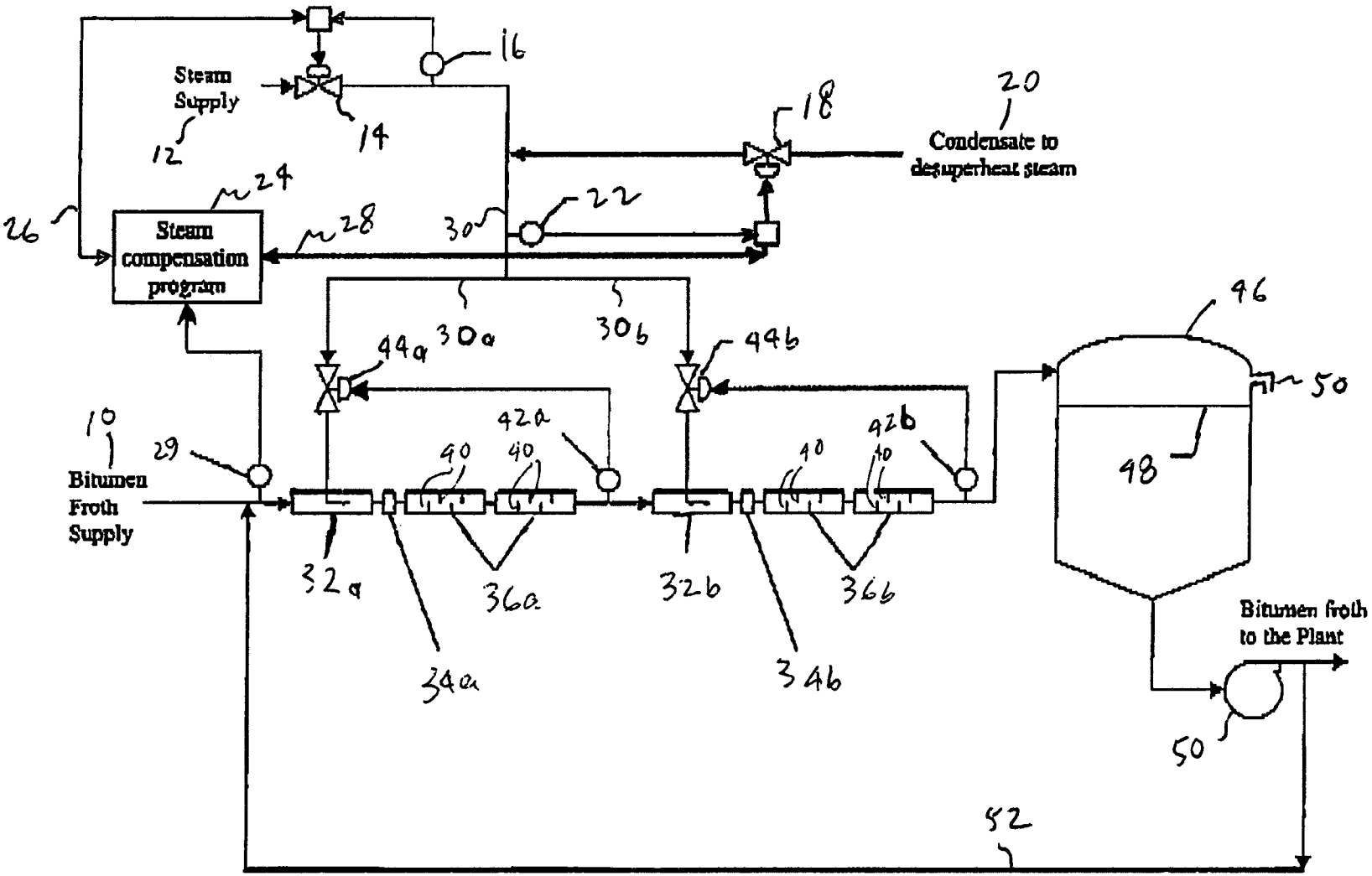
FIG. 1 is a functional block diagram of a preferred embodiment of a bitumen froth heating process arrangement of the invention.

FIG. 1 shows a functional block diagram of a preferred embodiment of a bitumen froth heating apparatus arranged in accordance with the invention. The input steam component 12 is supplied to a pressure control valve 14 which reduces the pressure to a set point pressure, which is typically about 90 psi. A pressure transmitter 16 is provided to monitor the pressure of the steam downstream from the pressure control valve 14 to provide a closed loop control mechanism to control the pressure of the steam at the set point pressure. The pressure controlled steam is supplied to a temperature control valve 18 that is used to control the supply of condensate 20 to cool the steam to its saturation point, which is about 300° F. at the controlled pressure of 90 psi. A temperature sensor 22 monitors the steam temperature downstream from the temperature control valve to provide a closed loop control mechanism to control the temperature of the steam at the temperature set point setting.

The optimum parameters for steam injection vary so a computer 24 executes a compensation program to review the instantaneously supplied instrumentation pressure 26 and temperature 28 measurements and adjusts inlet steam pressure and temperature set point settings as required. A pressure sensor 29 measures the pressure of the input bitumen component 10 to provide the compensation program executing on computer 24 with this parameter to facilitate optimum control of the parameters for steam injection.

To provide a greater capacity for supply or transfer of heat to the bitumen froth component, the pressure and temperature controlled steam 30 is split into two steam sub-streams 30*a*, 30*b*. Each steam sub-stream is supplied to a respective steam injector 32*a*, 32*b* and the steam injectors 32*a* and 32*b* are arranged in series to supply heat to the bitumen froth component stream 10. While two steam injectors arranged in series are shown in the figure, it will be understood that the bitumen froth component stream 10 could equally well be split into two sub-streams and each bitumen froth component sub-stream supplied to a respective steam injector arranged in parallel. Moreover, it will be understood that more than two sub-streams of either the steam component or the bitumen component streams could be provided if process flow rates require. A suitable inline steam injector 32*a*, 32*b* is manufactured by Komax Systems Inc. located in Calif., USA.

An inline steam injection heater works well in heating water compatible fluids but bitumen is not water compatible so additional mixing is advantageous to achieve uniform fluid temperature. Consequently, in the preferred embodiment depicted in FIG. 1, the bitumen and steam material flow mixture is passed through an inlet baffle 34*a*, 34*b* downstream from the respective steam injector 32*a*, 32*b*. The inlet baffle, which is shown more clearly in FIG. 2*a*, directs the material flow mixture downward to initiate the mixing action of the steam component with the bitumen froth component. Mixing of the material flow continues by passing the material flow through static mixers 36*a* and 36*b* respectively.

Figures 2, 2A:
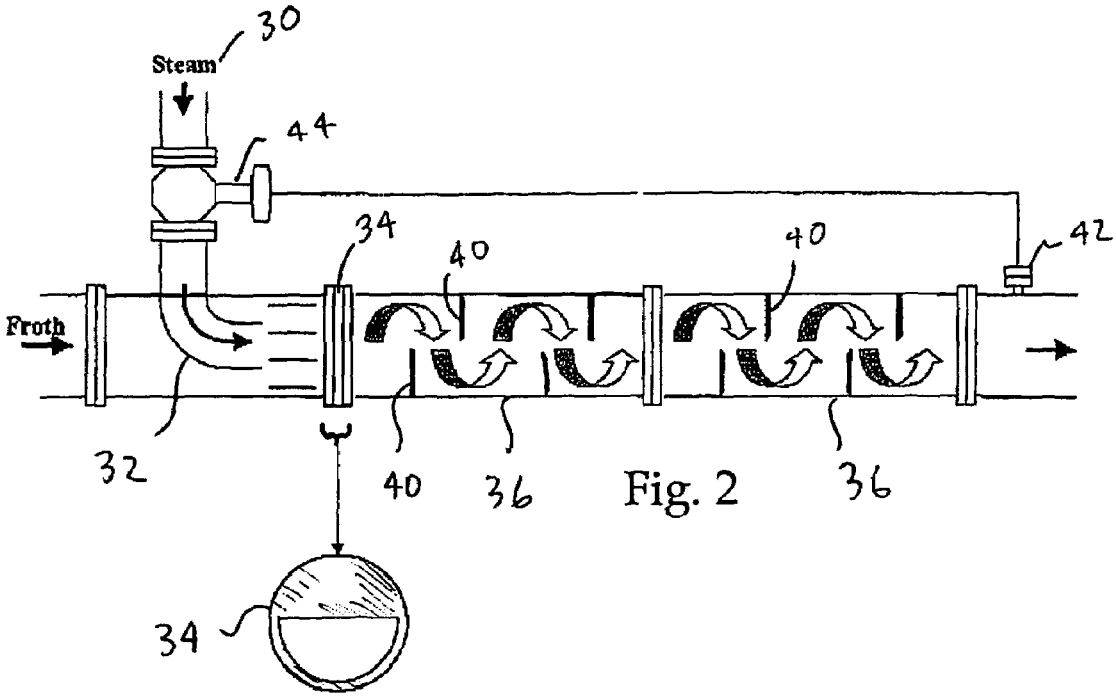
FIG. 2 is a cross section elevation view of an inline steam heater and mixer stage of FIG. 1.
FIG. 2*a* is an elevation view of a baffle plate of FIG. 2.

As seen most clearly in FIG. 2, the static mixers provide baffles 40 arranged along the interior volume of each static mixer to effect a mixing action of the material flowing through the static mixer. The mixing action of the material flow through the static mixer is provided by arranging the baffles 40 within the static mixer to impart a lateral, radial, tangential and/or circumferential directional component to the material flow that changes repeatedly along the length of the static mixer. Different static mixer designs and baffle arrangements may be used to advantage in mixing the steam component with the bitumen froth component.

A temperature transmitter 42 is located downstream of the mixers 36. The temperature of the material flow exiting the static mixer is measured by the temperature transmitter 42 and is used to control the rate of supply of steam to the inline steam injector 32 by the associated flow control valve 44. In this manner, a closed loop control system is provided to control the supply of the steam component to the bitumen froth component to obtain a set point or target output temperature of the material flow leaving the static mixer 36.

Referring again to FIG. 1, the heating system shown in FIG. 2 is arranged with a temperature transmitter 42*a*, 42*b* located downstream of each respective mixer 36*a*, 36*b*. The temperature of the material exiting each static mixer is measured by the temperature transmitter and is used to control the rate of supply of steam to the inline steam injectors 32*a*, 32*b* by the associated flow control valve 44*a*, 44*b* respectively. In this manner, a closed loop control system is provided to control the supply of the steam component to the bitumen froth component to obtain a set point or target output temperature of the material flow leaving each static mixer stage 36*a*, 36*b*. The water content of the bitumen froth component 10 can range form 30% to 50%. In a pilot plant implementation of the preferred embodiment, each inline steam heater 32*a*, 32*b* was found to be capable of heating about 10,000 barrels per hour of bitumen froth by about 30° F. utilizing about 80,000 pounds per hour of steam. By way of comparison to conventional process apparatus, the atmospheric tank method would use about 125,000 pounds of steam to achieve a similar heat transfer.

After heating, the heated bitumen froth is delivered to a plant for processing. To facilitate material flow rate co-ordination with the processing plant, the heated bitumen froth may be discharged to a downstream holding tank 46, preferably above the liquid level 48. The heated, mixed bitumen froth releases entrained air, preferably, therefore, the holding tank is provided with a vent 50 to disperse the entrapped air released from the bitumen froth. To maintain the temperature of the heated bitumen froth in the holding tank 46, a pump 50 and recycle line 52 are provided, which operate to recycle the hot bitumen froth from the holding tank to the process inlet of the heaters.

The invention has been described with reference to preferred embodiments. Those skilled in the art will perceive improvements, changes, and modifications. The scope of the invention including such improvements, changes and modifications is defined by the appended claims.

We claim:

1. Apparatus for heating a bitumen froth by steam, the apparatus comprising:

an injector body comprising a bitumen froth inlet for receiving the bitumen froth, a steam inlet for receiving the steam, and an injector outlet; and a static mixer body having first and second spaced ends and forming an enclosed passageway extending between the first and second ends, wherein the first end is in communication with the injector outlet, the static mixer body supporting a plurality of baffles disposed within the enclosed passageway to effect a mixing action of the bitumen froth and the steam flowing through the enclosed passageway thereof to form a heated feed;

wherein the steam inlet is disposed to inject the steam into the injector body towards the enclosed passageway in a direction generally parallel to the a longitudinal axis of the enclosed passageway; and wherein the apparatus is operably configured to: (a) force the bitumen froth and the steam through the injector outlet into the enclosed passageway, (b) force the bitumen froth and the steam through the enclosed passageway from the first end to the second end so as to cause the steam to contact the bitumen froth so as to form the heated feed, and (c) force all of the heated feed to exit through the second end of the static mixer body, including when the enclosed passageway is disposed parallel or about parallel to the horizontal axis.

2. The apparatus of claim 1 wherein the baffles are disposed within the static mixer body to impart a lateral, radial, tangential or circumferential directional component to the bitumen froth and the steam, the directional component changing repeatedly along a length of the enclosed passageway.

3. The apparatus of claim 1 further comprising a steam flow control valve to control a rate of supplying the steam to the steam inlet from a steam source.

4. The apparatus of claim 3 further comprising a first temperature transmitter disposed to measure a temperature of the heated feed exiting the enclosed passageway of the static mixer, wherein steam flow control valve is responsive to the measured temperature of the heated feed.

5. The apparatus of claim 1 further comprising a steam flow pressure control valve to control a pressure of the steam supplied to the steam inlet from a steam source.

6. The apparatus of claim 5 further comprising a pressure transmitter disposed to measure the pressure of the steam supplied from the steam flow pressure control valve, wherein the steam flow pressure control valve is operative to maintain the steam supplied to the steam inlet at a predetermined pressure in response to the measured pressure of the steam supplied from the steam flow pressure control valve.

7. The apparatus of claim 1 further comprising:

a condensate source and a steam source;

a condensate mixer operably configured to mix a condensate from the condensate source with the steam from the steam source for modulating a temperature of the steam supplied to the steam inlet; and a condensate flow control valve to control a supply of the condensate to the condensate mixer.

8. The apparatus of claim 7 further comprising a second temperature transmitter disposed to measure the temperature of the steam supplied to the steam inlet and relay a representation of the measured temperature of the steam to the condensate flow control valve, wherein the condensate flow control valve is operative to control the supply of the condensate to the steam supplied to the steam inlet.

9. The apparatus of claim 1 wherein the steam supplied to the steam inlet comprises saturated steam.

10. The apparatus of claim 9 wherein the steam supplied to the steam inlet has a temperature of about 300° F. and a pressure of about 90 psi.

11. The apparatus of claim 9 wherein the heated feed has a substantially uniform temperature.

12. The apparatus of claim 11 wherein the substantially uniform temperature is about 190° F.

13. Apparatus for heating a bitumen froth by steam, the apparatus comprising:

an injector body comprising walls defining a chamber of the injector body, a first injector inlet for introducing the bitumen froth having a bitumen froth flow into the chamber, a second injector inlet for introducing the steam having a steam flow into the chamber, and an injector outlet, wherein the second injector inlet is configured for introducing steam; and a static mixer body comprising:

a mixer inlet and a mixer outlet, the static mixer body forming an enclosed passageway extending between the mixer inlet and the mixer outlet, the mixer inlet being in fluid communication with the injector outlet for receiving the bitumen froth and the steam; and mixing means for mixing the bitumen froth and the steam flowing through the enclosed passageway of the static mixer body to form a heated feed;

wherein the injector body and the static mixer body are operably configured to: (a) force the bitumen froth and the steam through the enclosed passageway from the mixer inlet to the mixer outlet so as to cause the steam to contact the bitumen froth and form the heated feed, and (b) force all of the heated feed to exit through the mixer outlet, including when the enclosed passageway is disposed parallel or about parallel to the horizontal axis.

14. The apparatus of claim 13 wherein the mixing means impart a lateral, radial, tangential or circumferential directional component to the bitumen froth and the steam, the directional component changing repeatedly along a length of the enclosed passageway.

15. The apparatus of claim 13 wherein the mixing means comprises a plurality of static mixer barriers forming partial walls disposed within the enclosed passageway.

16. The apparatus of claim 15 wherein the steam injected by the second injector inlet has a temperature of about 300° F. to about 500° F. and a pressure of about 90 to 150 psi.

17. The apparatus of claim 15 wherein the heated feed produced by the static mixer body has a temperature of about 190° F.

18. The apparatus of claim 13 further comprising a steam flow control valve to control a rate of the steam flow into the chamber and a first temperature transmitter disposed to measure a temperature of the heated feed exiting the static mixer body, wherein the injector body, the static mixer body, the steam flow control valve and the first temperature transmitter form a first closed loop control system, the steam flow control valve being responsive to the measured temperature of the heated feed by the first temperature transmitter.

19. The apparatus of claim 18 further comprising a steam flow pressure control valve to control a pressure of the steam flow into the chamber and a pressure transmitter disposed to measure the pressure of the steam flow from the pressure control valve, wherein the injector body, the static mixer body, the steam flow control valve, the temperature transmitter, the steam flow pressure control valve and the pressure transmitter form a second closed loop control system, the steam flow pressure control valve being responsive to the measured pressure.

20. The apparatus of claim 19 further comprising a condensate flow control valve to control the supply of a condensate to the steam for modulating the temperature of the steam for injecting by the second injector inlet and a second temperature transmitter disposed to measure the temperature of the steam supplied to the second injector inlet, wherein the injector body, the static mixer body, the steam flow control valve, the first temperature transmitter, the steam flow pressure control valve, the pressure transmitter, the condensate flow control valve, and the second temperature transmitter form a third closed loop control system, the condensate flow control valve being responsive to the temperature of the steam measured by the second temperature transmitter.

21. The apparatus of claim 13 wherein the mixing means comprises a baffle disposed across the enclosed passageway.

22. The apparatus of claim 13 wherein the steam supplied to the second injector inlet comprises saturated steam.

* * * * *